US010273105B2

(12) United States Patent
Yamashita et al.

(10) Patent No.: US 10,273,105 B2
(45) Date of Patent: Apr. 30, 2019

(54) MARK DETECTION METHOD USING PRINTING APPARATUS AND PRINTING APPARATUS

(71) Applicant: SEIKO EPSON CORPORATION, Tokyo (JP)

(72) Inventors: Takahiro Yamashita, Matsumoto (JP); Tomoyuki Shiiya, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 40 days.

(21) Appl. No.: 15/053,510

(22) Filed: Feb. 25, 2016

(65) Prior Publication Data

US 2016/0272451 A1 Sep. 22, 2016

(30) Foreign Application Priority Data

Mar. 19, 2015 (JP) ..... 2015-055786

(51) Int. Cl.
*B65H 23/032* (2006.01)
*B65H 23/02* (2006.01)
*B65H 23/038* (2006.01)

(52) U.S. Cl.
CPC ..... *B65H 23/032* (2013.01); *B65H 23/0204* (2013.01); *B65H 23/0216* (2013.01); *B65H 23/038* (2013.01); *B65H 2511/23* (2013.01); *B65H 2511/512* (2013.01); *B65H 2553/30* (2013.01); *B65H 2553/412* (2013.01); *B65H 2553/81* (2013.01); *B65H 2553/83* (2013.01); *B65H 2601/2531* (2013.01)

(58) Field of Classification Search
CPC ..... B65H 23/0204; B65H 23/0216; B65H 2553/81; B65H 2553/822; B65H 2553/83; B65H 2511/512; B65H 23/032
See application file for complete search history.

(56) References Cited

U.S. PATENT DOCUMENTS 4,848,632 A * 7/1989 Mack ..... B65H 23/038 101/228
2009/0238619 A1 9/2009 Aoki
2010/0243697 A1 9/2010 Aoki

FOREIGN PATENT DOCUMENTS

JP 2009-227371 A 10/2009
JP 2010-228168 A 10/2010

* cited by examiner

*Primary Examiner* — Michael C McCullough
(74) *Attorney, Agent, or Firm* — Workman Nydegger

(57) ABSTRACT

A printing apparatus includes a mark sensor, a moving section, a web edge sensor, and a printer control section. The moving section can move the mark sensor in a direction intersecting a transport direction of a sheet, or in a width direction. The web edge sensor can detect a location of an edge of the sheet. The printer control section controls the moving section to compensate for a location of the mark sensor, on the basis of a detection result from the web edge sensor which indicates the location of the edge of the sheet.

6 Claims, 5 Drawing Sheets

MARK DETECTION METHOD USING PRINTING APPARATUS AND PRINTING APPARATUS

BACKGROUND

1. Technical Field

The present invention relates to a mark detection method using a printing apparatus and a printing apparatus employing the mark detection method.

2. Related Art

Some image forming apparatuses (printing apparatuses) known in the art feed a paper sheet (web) disposed in a roll shape to a printing section and form (record) images on this paper sheet. Such printing apparatuses use positioning marks (eye marks) formed on a paper sheet to adjust locations at which images are to be printed (e.g., JP-A-2010-228168).

In an exemplary printing apparatus as described in JP-A-2010-228168, when a web is displaced in its width direction during the transport, the detecting location of a mark sensor follows this web, thus preventing the mark sensor from failing to detect eye marks on the web. More specifically, the printing apparatus locates the centers of an eye mark and a blank area formed in the eye mark in a transport direction of the web on the basis of a detection signal from the mark sensor. Then, the printing apparatus calculates the difference between both center locations in a width direction of the web, determining the shift amount of the eye mark in the width direction. The printing apparatus moves the detecting location of the mark sensor in the width direction by the determined shift amount. In this way, the mark sensor successfully follows the shifted eye marks.

A typical size of the eye marks is as small as 5 mm per side. Therefore, the mark sensor needs to have a high-precision detection capability in order to detect variation in the center locations of the blank areas in the eye marks. Disadvantageously, using a high-precision detection sensor may lead to an increase in the cost of the printing apparatus.

Tiny foreign objects may adhere to the blank areas in some eye marks and affect the calculation of shift amounts of these eye marks. This may make it difficult for the mark sensor to follow the eye marks. Furthermore, the mark sensor has a detection spot that is smaller than each eye mark. If a web is greatly displaced in its width direction, for example at the start of the transport, the mark sensor may fail to detect eye marks. In short, the printing apparatus has trouble detecting the eye marks stably due to adhesion of foreign objects to the eye marks, the displacement of the web at the start of the transport, and the like.

SUMMARY

An advantage of some aspects of the invention is that a mark detection method using a printing apparatus and a printing apparatus are capable of addressing the above disadvantage. The mark detection method and the printing apparatus can be embodied by embodiments or aspects that will be described below.

According to a first aspect, a printing apparatus includes a mark sensor. A moving section can move the mark sensor in a direction intersecting a transport direction of a web. A web edge sensor can detect a location of an edge of the web. A control section controls the moving section to compensate for a location of the mark sensor, on the basis of a detection result from the web edge sensor, the detection result indicating the location of the edge of the web.

The moving section compensates for the location of the mark sensor on the basis of the detection result from the web edge sensor, thereby keeping the mark sensor at a fixed location with respect to the edge of the web. Consequently, the mark sensor can stably detect marks (eye marks) formed on the web.

According to a second aspect, the printing apparatus according to the first aspect preferably further includes a steering section that corrects a shift of the web in the direction intersecting the transport direction when the web is transported in a forward direction. The control section preferably corrects the shift of the web in the direction intersecting the transport direction, on the basis of the detection result from the web edge sensor which indicates the location of the edge of the web.

When the web is transported in the forward direction, the steering section corrects the location of the web, on the basis of the detection result from the web edge sensor. This correction reduces the shift of the web in the direction intersecting the transport direction, or the lateral displacement of the web.

According to a third aspect, when the web is transported in a reverse direction, the control section in the printing apparatus according to the second aspect preferably controls the moving section to compensate for the location of the mark sensor, on the basis of the detection result from the web edge sensor which indicates the location of the edge of the web.

When the web is transported in the reverse direction, the moving section compensates for the location of the mark sensor, on the basis of the detection result from the web edge sensor. The mark sensor thereby can stably detect marks (eye marks) formed on the web. Moreover, the detection result from the web edge sensor is shared by the steering section and the moving section to correct the location of the web and compensate for the location of the mark sensor, respectively. This sharing manner can limit an increase in the cost of the printing apparatus.

According to a fourth aspect, the steering section in the printing apparatus according to the second or third aspect is preferably positioned upstream of a printing section.

By positioning the steering section upstream of a printing section in the transport path of the web, the lateral displacement of the web in the printing section is reduced so that images can be formed at predetermined printing locations.

According to a fifth aspect, the web edge sensor in the printing apparatus according to one of the first to fourth aspects is preferably positioned upstream of the mark sensor.

The web edge sensor is positioned upstream of the mark sensor in the transport path of the web, and the location of the mark sensor is compensated for on the basis of the information regarding the edge of the web which is detected by the web edge sensor. Consequently, the mark sensor can stably detect marks (eye marks) formed on the web.

According to a sixth aspect, the mark sensor in the printing apparatus according to one of the first to fifth aspects preferably has a detection spot that is larger than a width of a mark.

The mark sensor with its detection spot (detection area) larger than a width of each mark can detect marks stably in comparison to a mark sensor with its detection spot smaller than the width of each mark.

According to a seventh aspect, a mark detection method using a printing apparatus that includes a mark sensor and a web edge sensor capable of detecting a location of an edge of a web includes detecting a mark while compensating for a location of the mark sensor on the basis of a detection result from the web edge sensor, the detection result indicating the location of the edge of the web.

The mark sensor detects marks while its location with respect to the edge of the web is compensated for on the basis of the detection result from the web edge sensor which indicates the location of the edge of the web. More specifically, the mark sensor detects marks while its location is compensated for so that the mark sensor is kept at a fixed location with respect to the edge of the web. Therefore, the mark sensor can detect the marks stably.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
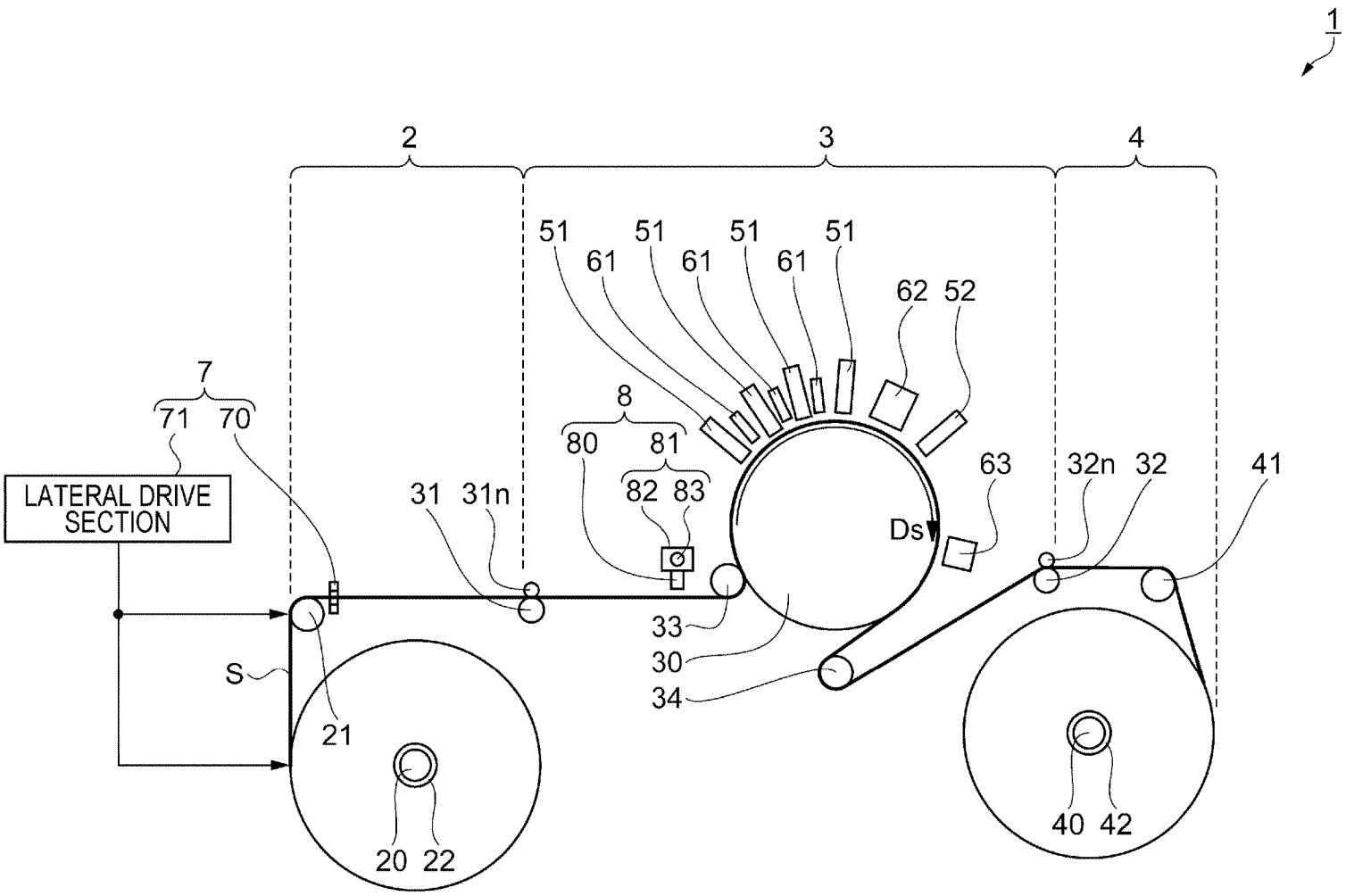
FIG. 1 is a schematic view illustrating a configuration of a printer according to a first embodiment of the invention.

Some embodiments of the invention will be described below with reference to the accompanying drawings. Embodiments of the invention are exemplary and are not intended to limit the invention. Therefore, various modifications and variations are possible without departing from the technical scope of the invention. It should be noted that the scaling of layers and members illustrated in the drawings differs from a real one, and some layers and members are enlarged so as to be distinguishable from one another.

First Embodiment

FIG. 1 is a schematic view illustrating a configuration of a printer according to a first embodiment of the invention.

Outline of Printer

First, a description will be given of an outline of a printer 1 with reference to FIG. 1. The printer 1 is an example of a "printing apparatus" herein.

As illustrated in FIG. 1, the printer 1 includes a feeding axis 20 and a winding axis 40. A sheet S (web) is wound in a roll shape around both the feeding axis 20 and the winding axis 40 and stretched therebetween along a transport path. While the sheet S is being transported in a transport direction Ds from the feeding axis 20 to the winding axis 40, images are recorded on the sheet S. Types of sheets S are broadly divided into a paper-based sheet and a film-based sheet. Concrete examples of a paper-based sheet include a high-quality paper sheet, a cast paper sheet, an art paper sheet, and a coated paper sheet; concrete examples of a film-based sheet include a synthetic sheet, a PET (polyethylene terephthalate) sheet, and a PP (polypropylene) sheet.

The printer 1 includes a feeding section 2 (feeding region), a processing section 3 (processing region), and a winding section 4 (winding region). In the feeding section 2, the sheet S is fed from the feeding axis 20. In the processing section 3, images are recorded (printed) on the sheet S fed from the feeding axis 20. In the winding section 4, the sheet S on which the images have been recorded (printed) is wound around the winding axis 40. The processing section 3 is an example of a "printing section" herein. Hereinafter, a surface of the sheet S on which images will be printed or have been printed is referred to as a front surface; the opposite surface is referred to as a rear surface.

The feeding section 2 is provided with: the feeding axis 20 around which a first end of sheet S is wound; and a driven roller 21 over which the sheet S pulled out from the feeding axis 20 runs. The sheet S is wound around the feeding axis 20 with a core tube 22 removable from the feeding axis 20 therebetween. The first end of the sheet S is wound around the feeding axis 20 with its front surface facing outward, so that the sheet S is supported by the feeding axis 20. The feeding axis 20 rotates in a clockwise direction in FIG. 1, feeding the sheet S wound around the feeding axis 20 to the processing section 3 via the driven roller 21. When the sheet S that has been wound around the feeding axis 20 is finished, this sheet S can be replaced with a new sheet S by attaching a new core tube 22 around which the new sheet S is wound in a roll shape to the feeding axis 20.

Both the feeding axis 20 and the driven roller 21 are movable in a width direction Dw that is orthogonal to the transport direction Ds, or in a vertical direction with respect to the sheet of FIG. 1. The feeding section 2 has a steering mechanism 7 that reduces the lateral displacement of the sheet S by adjusting the locations of the feeding axis 20 and the driven roller 21 in the width direction Dw, or in their axial direction. More specifically, when the sheet S is transported in the transport direction Ds, the steering mechanism 7 in the feeding section 2 corrects the shift of the sheet S in the width direction Dw, or in a direction that is orthogonal to the transport direction Ds of the sheet S. In short, the feeding section 2 can correct the shift of the sheet S, namely, the shift of an edge of the sheet S in the width direction Dw. Herein, the steering mechanism 7 is an example of a steering section.

The steering mechanism 7 includes an edge sensor 70 and a lateral drive section 71. When the sheet S is transported in the transport direction Ds, the steering mechanism 7 corrects the shift of the sheet S in the width direction Dw on the basis of the detection result from the edge sensor 70 which indicates the location of an edge of the sheet S, reducing the lateral displacement of the sheet S.

The edge sensor 70 is disposed between the driven roller 21 and a front drive roller 31 while facing an edge portion of the sheet S in the width direction Dw, and detects the edge (edge location) of the sheet S in the width direction Dw. The edge sensor 70 has a transmitter (not illustrated) that emits ultrasonic waves and a receiver (not illustrated) that receives ultrasonic waves. The transmitter and the receiver are disposed opposite each other with the sheet S therebetween. The transmitter emits ultrasonic waves to a circular detection area having a diameter of approximately 10 mm in the width direction Dw, and the receiver receives the ultrasonic waves that have passed through the detection area. The lateral drive section 71 corrects the shift of the sheet S in the width direction Dw by adjusting the locations of the feeding axis 20 and the driven roller 21 in the width direction Dw on the basis of the detection result from the edge sensor 70. In this way, the lateral drive section 71 reduces the lateral displacement of the sheet S. Herein, the edge sensor 70 is an example of a web edge sensor.

In the processing section 3, the sheet S fed from the feeding section 2 is subjected to predetermined processes by recording heads 51 and 52 and UV lamps 61, 62, and 63 arranged on the outer circumferential surface of a rotatable drum 30 while being supported by the rotatable drum 30. Through these processes, images are recorded (printed) on the sheet S. The processing section 3 is provided with the front drive roller 31 and a rear drive roller 32 on both sides of the rotatable drum 30. Images are recorded on the sheet S transported from the front drive roller 31 to the rear drive roller 32 while being supported by the rotatable drum 30.

The above steering mechanism 7 is disposed upstream of the processing section 3 in the transport path. The steering mechanism 7 disposed in this manner reduces the displacement of a printing site, or the lateral displacement of the sheet S, in the processing section 3. This can form images on the sheet S at fixed locations.

The processing section 3 is disposed downstream of the steering mechanism 7 in the transport path. In other words, the steering mechanism 7 is disposed upstream of the processing section 3 in the transport path. The steering mechanism 7 disposed in this manner reduces the displacement of a printing site, or the lateral displacement of the sheet S, in the processing section 3. This can form images on the sheet S at fixed locations.

The front drive roller 31 has an outer circumferential surface on which a plurality of small-sized projections are formed by means of spraying. The sheet S fed from the feeding section 2 runs over the front drive roller 31 with its rear surface contacting this front drive roller 31. The front drive roller 31 rotates in the clockwise direction of FIG. 1, transporting the sheet S fed from the feeding section 2 to the downstream side of the transport path. The front drive roller 31 is paired with a nip roller 31*n*. This nip roller 31*n* abuts against the front surface of the sheet S while being biased toward the front drive roller 31, so that the sheet S is pressed by the nip roller 31*n* and the front drive roller 31 from both surfaces. Consequently, an appropriate frictional force is generated between the front drive roller 31 and the sheet S, enabling the front drive roller 31 to reliably transport the sheet S.

The rotatable drum 30 has a cylindrical body with a diameter of substantially 400 mm. This rotatable drum 30 is supported by a support mechanism (not illustrated) so as to be rotatable in both the transport direction Ds and the reverse direction. When transported from the front drive roller 31 to the rear drive roller 32, the sheet S runs over the rotatable drum 30 with its rear surface contacting this rotatable drum 30. With the frictional force between the rotatable drum 30 and the sheet S, the rotatable drum 30 can support the sheet S from the rear surface while rotating in the transport direction Ds of the sheet S.

In the processing section 3, driven rollers 33 and 34 are disposed on both sides of the part of the rotatable drum 30 over which the sheet S runs; the sheet S is curved by the driven rollers 33 and 34. The sheet S runs over the driven roller 33 with its front surface contacting this driven roller 33 while being curved between the front drive roller 31 and the rotatable drum 30 by the driven roller 33. Likewise, the sheet S runs over the driven roller 34 with its front surface contacting this driven roller 34 while being curved between the rotatable drum 30 and the rear drive roller 32 by the driven roller 34.

The rear drive roller 32 has an outer circumferential surface on which a plurality of small-sized projections are formed by means of spraying. The sheet S transported from the rotatable drum 30 via the driven roller 34 runs over the rear drive roller 32 with its rear surface contacting this rear drive roller 32. The rear drive roller 32 rotates in the clockwise direction of FIG. 1, transporting the sheet S to the winding section 4. The rear drive roller 32 is paired with a nip roller 32*n*. This nip roller 32*n* abuts against the front surface of the sheet S while being biased toward the rear drive roller 32, so that the sheet S is pressed by the nip roller 32*n* and the rear drive roller 32 from both surfaces. Consequently, a frictional force is generated between the rear drive roller 32 and the sheet S, enabling the rear drive roller 32 to reliably transport the sheet S.

As described above, the sheet S is transported from the front drive roller 31 to the rear drive roller 32 while being supported by the outer circumferential surface of the rotatable drum 30. The processing section 3 is provided with the plurality of recording heads 51 corresponding to different colors in order to print color images on the front surface of the sheet S supported by the rotatable drum 30. More specifically, the four recording heads 51 corresponding to yellow, cyan, magenta, and black are arrayed in this order in the transport direction Ds. The recording heads 51 are disposed opposite the front surface of the sheet S running over the rotatable drum 30 with a slight clearance therebetween and eject corresponding color inks through their nozzles in an ink jet manner. The recording heads 51 form the color images on the front surface of the sheet S by ejecting the inks onto the sheet S transported in the transport direction Ds.

The above inks may be UV (ultraviolet) inks, or photocurable inks, that can be cured by the irradiation of UV rays or light. Therefore, the processing section 3 is provided with the UV lamps 61 and 62 in order to cure and fix the inks to the sheet S. The inks are cured in two steps; a pre-curing step and a curing step. The UV lamps 61 disposed between the plurality of recording heads 51 are used for the pre-curing step. Each UV lamp 61 cures (pre-cures) wetted ink by irradiating the ink with UV rays of low irradiation intensity so that the ink spreads out at a sufficiently lower rate than when UV rays are not used. In this case, the ink is not cured completely. The UV lamp 62 disposed downstream of the plurality of recording heads 51 in the transport direction Ds is used for the curing step. The UV lamp 62 cures wetted ink by irradiating the ink with UV rays of higher irradiation intensity than each UV lamp 61 so that the ink stops spreading out.

As described above, the UV lamps 61 disposed between the plurality of recording heads 51 pre-cure the color inks on the sheet S which have been ejected by the recording heads 51 disposed upstream of the UV lamps 61 in the transport direction Ds. In this case, when a first recording head 51 ejects ink onto the sheet S, the ink is pre-cured until the ink has reached an adjacent second recording head 51 disposed downstream of the first recording head 51 in the transport direction Ds. This can prevent a situation in which different color inks mix and form images of mixed colors. As a result, the plurality of recording heads 51 can form color images on the sheet S by ejecting different color inks so as not to be mixed with one another. The UV lamp 62 disposed downstream of the plurality of recording heads 51 in the transport direction Ds is used for the curing step. The UV lamp 62 completely cures the color images that have been formed by the plurality of recording heads 51, fixing the color images to the sheet S.

The recording head 52 is disposed downstream of the UV lamp 62 in the transport direction Ds. This recording head 52 is disposed opposite the front surface of the sheet S running over the rotatable drum 30 with a slight clearance therebetween, and ejects a transparent UV ink onto the front surface of the sheet S through its nozzles in an ink jet manner. Thus, the recording head 52 ejects the transparent ink onto the color images formed with the four color inks from the recording heads 51. This transparent ink is ejected over the surfaces of the color images, providing the color images with a texture, such as gloss or matte. The UV lamp 63 is disposed downstream of the recording head 52 in the transport direction Ds. This UV lamp 63 completely cures the transparent ink ejected from the recording head 52 by emitting strong UV rays to the transparent ink. The transparent ink is thereby fixed to the front surface of the sheet S.

As described above, in the processing section 3, inks are ejected onto the sheet S running over the outer circumferential surface of the rotatable drum 30 and cured appropriately, whereby color images coated with the transparent ink are formed. Then, the rear drive roller 32 transports the sheet S on which the color images have been formed to the winding section 4.

The processing section 3 is further provided with a mark detecting section 8 between the front drive roller 31 and the driven roller 33. Thus, the mark detecting section 8 is disposed downstream of the steering mechanism 7 in the transport path. This mark detecting section 8 includes a mark sensor 80 and a moving section 81.

The mark sensor 80 is disposed downstream of the edge sensor 70 in the transport path. In other words, the edge sensor 70 is disposed upstream of the mark sensor 80 in the transport path. By disposing the edge sensor 70 upstream of the mark sensor 80 in the transport path, the detection result from the edge sensor 70 can be used to adjust the location of the mark sensor 80, details of which will be described later. The mark sensor 80 includes a light emitting unit (not illustrated) that emits light and a light receiving unit (not illustrated) that detects light. Examples of the light emitting unit include a light emitting diode (LED) and a tungsten lamp. Examples of the light receiving unit include a photodiode and other optical sensors. The light receiving unit outputs a signal whose level is proportional to the intensity of received light, as a detected value.

The moving section 81 includes a guide rail 83, a support mechanism (not illustrated) that supports the guide rail 83, and a carriage 82. The carriage 82 is supported by the guide rail 83 so as to be movable in the width direction Dw. The mark sensor 80 is mounted on the carriage 82 so as to be movable in the width direction Dw. In other words, the mark detecting section 8 is provided with the moving section 81 that can move the mark sensor 80 in a direction that intersects the transport direction Ds of the sheet S, or in the width direction Dw. The mark sensor 80 thereby can be moved in the width direction Dw by the moving section 81.

In addition to the winding axis 40 around which a second end of the sheet S is wound, the winding section 4 has a driven roller 41 between the winding axis 40 and the rear drive roller 32. The sheet S runs over the driven roller 41 with its rear surface contacting this driven roller 41. The winding axis 40 supports the sheet S by winding the second end of the sheet S with its front surface facing outward. When the winding axis 40 rotates in the clockwise direction in FIG. 1, the sheet S transported from the rear drive roller 32 is wound around the winding axis 40 via the driven roller 41. The sheet S is wound around the winding axis 40 with a core tube 42 removable from the winding axis 40 therebetween. When the entire sheet S is wound around the winding axis 40, the sheet S can be removed from the winding axis 40 together with the core tube 42.

Operations of Printer

Figure 2A:
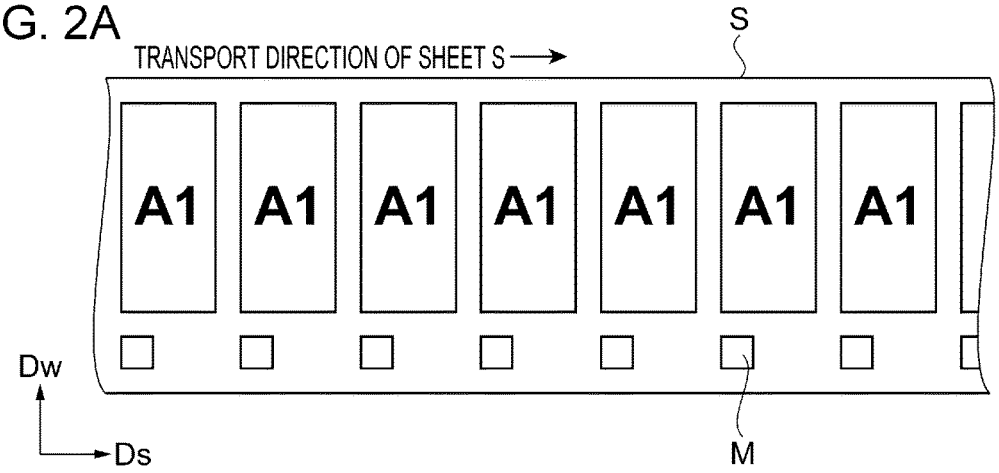
FIGS. 2A, 2B, and 2C are schematic views illustrating operational states of the printer.
Figure 2B:
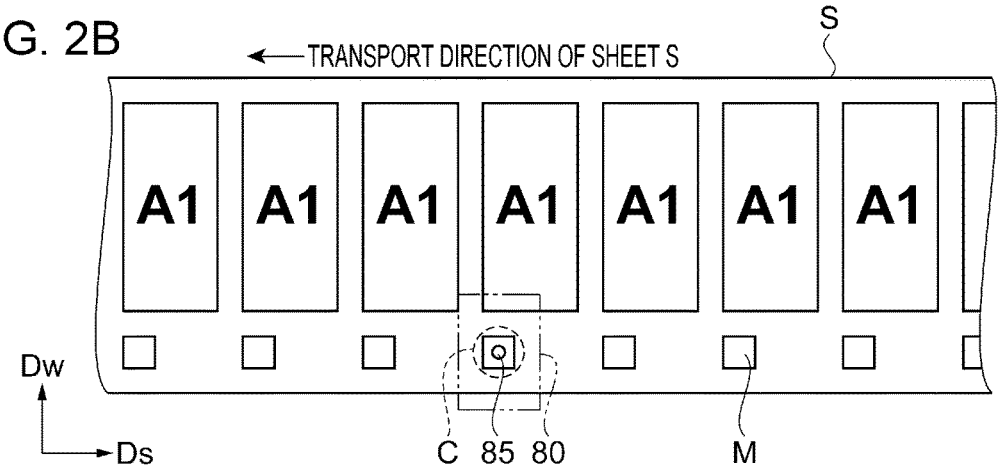
Figure 2C:
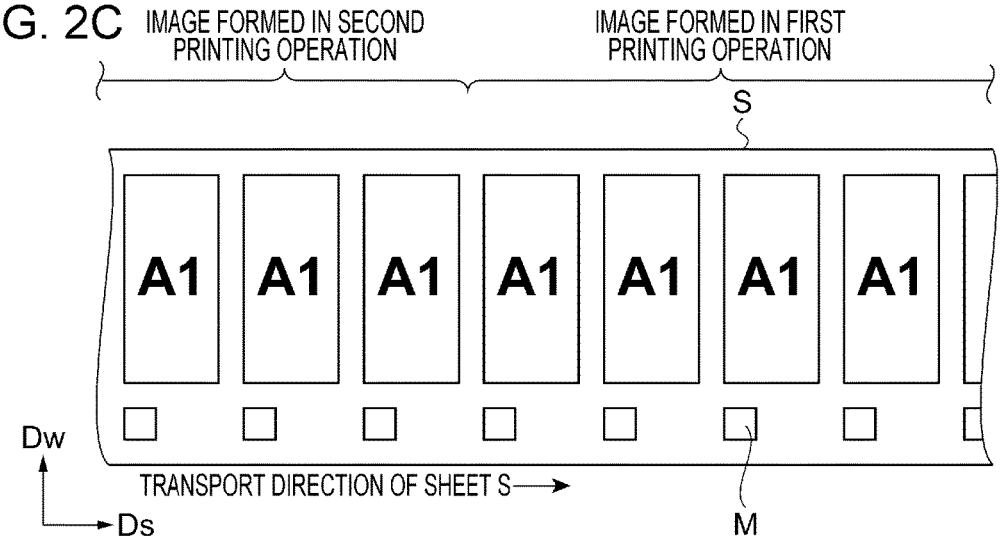

FIGS. 2A, 2B, and 2C are schematic views illustrating operational states of the printer. In FIGS. 2A, 2B, and 2C, the sheet S is indicated by a solid line, and the mark sensor 80 is indicated by an alternate long and two short dashes line. No other components are illustrated.

The printer 1 performs a first printing operation, a rewinding operation, and a second printing operation; in the first printing operation, images are printed on the sheet S transported in the transport direction Ds, in the rewinding operation, the sheet S is rewound, and in the second printing operation, the printing of images resumes after the rewinding operation. FIG. 2A schematically illustrates a state of the sheet S in the first printing operation. FIG. 2B schematically illustrates a state of the sheet S in the rewinding operation. FIG. 2C schematically illustrates a state of the sheet S in the second printing operation. With reference to FIGS. 2A, 2B, and 2C, the operations of the printer 1 will be described below.

The printer 1 performs the first printing operation while feeding the sheet S wound around the feeding axis 20 from the feeding section 2 to the processing section 3. In the first printing operation, images A1 and marks M (eye marks) are printed on the sheet S, as illustrated in FIG. 2A. The marks M may be formed with a color ink at the same time as the forming of the images A1. The marks M may have a square shape with a size of approximately 5 mm per side and are arrayed at regular spacings in the transport direction Ds. The marks M may be printed within any areas in which no images A1 are printed. For example, the marks M may be formed within central areas of the sheet S so as not overlap the images A1. Alternatively, the marks M may be formed on the sheet S in advance, and only the images A1 may be formed on the sheet S in the first printing operation.

When the sheet S is transported in the transport direction Ds, namely, in a forward direction, the above steering mechanism 7 operates. Since the sheet S is transported in the forward direction in the first printing operation, the steering mechanism 7 corrects the shift of an edge of the sheet S, thereby reducing the lateral displacement of the sheet S. More specifically, when the sheet S is transported in the forward direction, the steering mechanism 7 corrects the shift of the edge of the sheet S on the basis of information regarding the location of the edge of the sheet S in the width direction Dw which has been detected by the edge sensor 70, thereby reducing the lateral displacement of the sheet S. Consequently, the sheet S is not displaced less in the processing section 3, so that images are formed at preset locations.

For the above reason, the images A1 and the marks M are printed at fixed locations with respect to the edge of the sheet S in the first printing operation. Moreover, as will be described later, the steering mechanism 7 also operates in the second printing operation and prints new images A1 so that marks M are printed at fixed locations with respect to the edge of the sheet S.

There are cases where the printer 1 is forced to stop in the course of the printing operation due to the maintenance of the processing section 3 or user's requirements, for example. The printing operation stops after the printing process using the transparent UV ink has been completed in the processing section 3. When resuming the printing operation, the printer 1 rewinds the sheet S in a direction that is the reverse of the transport direction Ds and then transports the sheet S in the forward direction. The operation of rewinding the sheet S in the reverse direction is the rewinding operation; the operation of transporting the sheet S in the forward direction and printing images after the rewinding of the sheet S is the second printing operation. In short, the rewinding operation follows the first printing operation, and the second printing operation follows the rewinding operation.

In the rewinding operation, the mark sensor 80 causes the light emitting unit to irradiate the sheet S with a light beam 85 having a diameter of approximately 1 mm, as illustrated in FIG. 2B. More specifically, the light emitting unit in the mark sensor 80 alternately irradiates the marks M and sites other than the marks M on the front surface of the sheet S with the light beam 85.

The light receiving unit in the mark sensor 80 detects the state of light reflected from a region (inspection spot) C surrounded by a broken line in FIG. 2B and outputs either a low-level signal or a high-level signal. More specifically, when a site on the front surface of the sheet S outside the marks M is positioned within the inspection spot C, or when a site other than the marks M on the front surface of the sheet S is irradiated with the light beam 85, the light receiving unit in the mark sensor 80 outputs the low-level signal. When a mark M is positioned within the inspection spot C, or when a mark M is irradiated with the light beam 85, the light receiving unit in the mark sensor 80 outputs the high-level signal.

The inspection spot C is a detection area of the light receiving unit (optical sensor) in the mark sensor 80, and has a larger diameter than the width of each mark M, or the size thereof in the width direction Dw. By setting the inspection spot C larger than each mark M in the width direction Dw, the marks M can be detected stably by the mark sensor 80.

While the sheet S is being rewound in the reverse direction, the steering mechanism 7 does not operate. Thus, the sheet S may be laterally displaced in the rewinding operation. In other words, an edge of the sheet S in the width direction Dw may have been shifted. Therefore, in the rewinding operation, the location of the mark sensor 80 is compensated for (adjusted) so as to follow the laterally displaced sheet S.

More specifically, the moving section 81 in the mark detecting section 8 adjusts the location of the mark sensor 80 in the width direction Dw so as to follow the laterally displaced sheet S, or a shifted edge of the sheet S, on the basis of information regarding the location of the edge of the sheet S in the width direction Dw which has been detected by the edge sensor 70. Consequently, in the rewinding operation, the mark sensor 80 is positioned at a fixed location with respect to the edge of the sheet S. The light receiving unit in the mark sensor 80 thereby can detect the marks M stably without causing detection failures. Thus, even if the steering mechanism 7 does not operate and the sheet S is thereby laterally displaced in the rewinding operation, the mark sensor 80 can detect the marks M stably. This is because the mark sensor 80 is positioned or maintained at a fixed location with respect to an edge of the sheet S.

The first embodiment also provides a mark detection method using the mark sensor 80 that can detect the marks M and the edge sensor 70 that can detect the location of an edge of the sheet S. In this mark detection method, the marks M are detected by the mark sensor 80 while the location of the mark sensor 80 is compensated for on the basis of a detection result from the edge sensor 70 which indicates the location of the edge of the sheet S.

A detection result from the edge sensor 70 which indicates the location of an edge of the sheet S can be used to both reduce the lateral displacement of the sheet S during a printing operation with the steering mechanism 7 and adjust the location of the mark sensor 80 during the rewinding operation. The steering mechanism 7 and the mark detecting section 8 share this detection result, which can obviate the need to prepare a new edge sensor 70 for use in adjusting the location of the mark sensor 80, thereby limiting an increase in the cost of the printer 1.

As described above, the second printing operation corresponds to a printing operation performed after the rewinding operation. As illustrated in FIG. 2C, the images A1 and the marks M sequentially formed in the second printing operation are arranged adjacent to those formed in the first printing operation, and the images A1 and the marks M for the first and second printing operations are arrayed at equal spacings. Thus, the images A1 and the marks M for the first printing operation and those for the second printing operation are sequentially arrayed at equal spacings with no extra blank therebetween. In other words, in the second printing operation, new images A1 and marks M are formed adjacent to images A1 and marks M that have been formed in the first printing operation with no extra blank therebetween.

If the sheet S is transported at different speeds in the processing section 3 during the first and second printing operations, respective printed images exhibit different hues. To avoid this situation, a preparation period is preferably reserved in the second printing operation. During this preparation period, the transport speed of the sheet S is adjusted so as to be the same as the transport speed before the stop of the print operation, namely, the transport speed in the first printing operation. After the sheet S has been transported at the same speed as in the first printing operation, the printing operation is resumed in the processing section 3.

In the rewinding operation, it is preferable that marks M on the sheet S be counted accurately and the transport amount of the sheet S be determined accurately from the number of marks M, details of which will be described later. In the second printing operation, the initial position of the sheet S to be subjected to the printing process in the processing section 3 is pinpointed from the information regarding the transport amount of the sheet S which has been determined in the rewinding operation. Then, images are recorded or printed on the sheet S. Since the transport amount of the sheet S is determined accurately in the rewinding operation, a new image can be formed at a preset location (target location) in the second printing operation. Consequently, images can be formed in the first and second printing operations with no extra blank therebetween.

The printer 1 adjusts an initial print position for the second printing operation from information regarding the transport amount of the sheet S which has been determined in the rewinding operation, so no extra blank is formed between images that have been formed before the stop of the printing operation and after the resuming thereof. Therefore, the printer 1 successfully reduces the risk of forming an extra blank, namely, decreases a printing loss when a printing operation is resumed after having been stopped due to maintenance or user's requirement, for example. In short, the printer 1 achieves high printing productivity.

After having formed images A1 and marks M in the first printing operation and rewound the sheet S toward the feeding section 2, the printer 1 may form different images in the second printing operation at a location close to the image A1 and the mark M that have been formed in the first printing operation. For example, the printer 1 may form ID patterns close to the images A1 that have been formed in the first printing operation. Alternatively, the printer 1 may form images in the first printing operation and then the backgrounds of these images in the second printing operation.

Electrical Configuration of Printer

Figure 3:
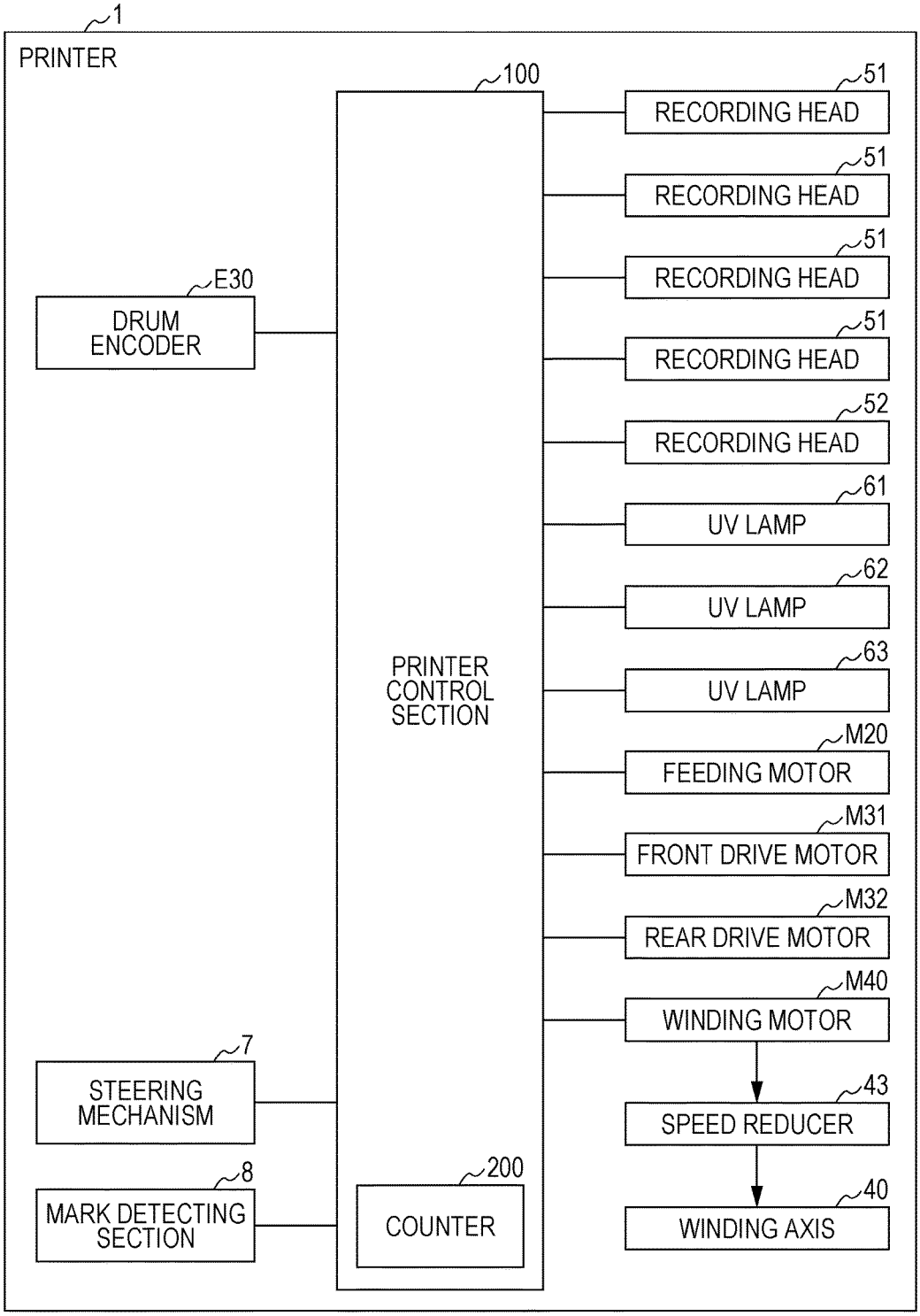
FIG. 3 is a block diagram of an electrical configuration of the printer.

FIG. 3 is a block diagram of an electrical configuration of the printer. With reference to FIG. 3, a description will be given below of an electrical configuration that controls the printer 1.

As illustrated in FIG. 3, the printer 1 has a printer control section 100 that controls individual sections in the printer 1. The recording heads 51 and 52, the UV lamps 61 and 62, a sheet transport system, and other units are controlled by this printer control section 100. Herein, the printer control section 100 is an example of a control section.

The printer control section 100 controls the timing at which each recording head 51 ejects the ink in order to form color images, in accordance with the transport of the sheet S. More specifically, the printer control section 100 controls the ink ejection timing, on the basis of an output (detection value) of a drum encoder E30; the drum encoder E30 is attached to the rotatable axis of the rotatable drum 30 and detects the rotation amount of the rotatable drum 30. In other words, the printer control section 100 refers to the output of the drum encoder E30 which indicates the detected rotation amount of the rotatable drum 30 and controls the ink ejection timing of each recording head 51. The recording heads 51 thereby can eject the inks to the sheet S at target locations, forming (printing) color images on the sheet S.

The printer control section 100 also controls the timing at which the recording head 52 ejects the transparent ink, on the basis of an output of the drum encoder E30. The recording head 52 thereby can eject precisely the transparent ink to color images that have been formed by the plurality of recording heads 51. In addition, the printer control section 100 controls the lighting timing and irradiance of the UV lamps 61, 62, and 63.

The printer control section 100 controls the transport of the sheet S, or the sheet transport system, which has been described with reference to FIG. 1. The feeding axis 20, the front drive roller 31, the rear drive roller 32, and the winding axis 40, which are members of the sheet transport system, are connected to motors. The printer control section 100 rotates these motors and simultaneously adjusts their rotation speeds and torques, thereby controlling the transport of the sheet S.

More specifically, the printer control section 100 rotates a feeding motor M20 that drives the feeding axis 20, supplying the sheet S from the feeding axis 20 to the front drive roller 31. In this case, the printer control section 100 adjusts the tension of the sheet S between the feeding axis 20 and the front drive roller 31 by controlling the torque of the feeding motor M20.

The printer control section 100 rotates a front drive motor M31 and a rear drive motor M32 to drive the front drive roller 31 and the rear drive roller 32. The sheet S fed from the feeding section 2 thereby passes through the processing section 3. In this case, the printer control section 100 controls the rotation speed of the front drive motor M31 and the torque of the rear drive motor M32. In this case, the printer control section 100 keeps the rotation speed of the front drive motor M31 constant, on the basis of the encoder output of the front drive motor M31. The sheet S is thereby transported at a constant speed by the front drive roller 31.

The printer control section 100 adjusts the tension of the sheet S between the front drive roller 31 and the rear drive roller 32 by controlling the torque of the rear drive motor M32.

The printer control section 100 rotates a winding motor M40 connected to the winding axis 40 through a speed reducer 43, whereby the sheet S transported by the rear drive roller 32 is wound around the winding axis 40. In this case, the printer control section 100 adjusts the tension of the sheet S between the rear drive roller 32 and the winding axis 40 by controlling the torque of the winding motor M40.

The printer control section 100 controls the steering mechanism 7 installed in the feeding section 2. In the first and second printing operations, the printer control section 100 controls the lateral drive section 71 on the basis of a detection result from the edge sensor 70 which indicates information regarding the location of an edge of the sheet S. More specifically, the printer control section 100 adjusts the locations of the feeding axis 20 and the driven roller 21 in the width direction Dw. The edge of the sheet S in the width direction Dw is thereby adjusted so as to move to a target location. Consequently, the edge of the sheet S is kept at the target location in the first and second printing operations. This makes it possible to reduce the lateral displacement of the sheet S and form (print) images A1 and marks M at target locations with respect to the edge of the sheet S. Thus, when the sheet S is transported in the transport direction Ds, or the forward direction, the steering mechanism 7 corrects the shift of the sheet S in a direction that intersects the forward direction of the sheet S, namely, in the width direction Dw. The printer control section 100 corrects the shift of the sheet S in the width direction Dw, on the basis of the detection result from the edge sensor 70 which indicates the edge location of the sheet S.

The printer control section 100 controls the mark detecting section 8 installed in the processing section 3. In the rewinding operation, the printer control section 100 controls the moving section 81 to compensate for the location of the mark sensor 80 so as to follow a varying edge location of the sheet S, or the laterally displaced sheet S, on the basis of the detection result from the edge sensor 70 which indicates the information regarding the location of the edge of the sheet S. In other words, in the rewinding operation, the printer control section 100 controls the moving section 81 to position and keep the mark sensor 80 at a fixed location in the width direction Dw. The mark sensor 80 thereby can detect marks M stably. In short, the printer control section 100 controls the moving section 81 to compensate for the location of the mark sensor 80, on the basis of the detection result from the edge sensor 70 which indicates the location of the edge of the sheet S. More specifically, when the sheet S is transported in a direction that is the reverse of the transport direction Ds, the printer control section 100 controls the moving section 81 to compensate for the location of the mark sensor 80, on the basis of the detection result from the edge sensor 70 which indicates the location of t edge of the sheet S.

In the rewinding operation, the printer control section 100 counts marks M preformed on the sheet S and obtains information regarding the transport amount of the sheet S. More specifically, the printer control section 100 has a built-in counter 200. Whenever the mark sensor 80 detects a mark M, the printer control section 100 updates a count value stored in the counter 200. The printer control section 100 can get to know the transport amount of the sheet S accurately by referring to the count value of the counter 200.

Figure 4A:
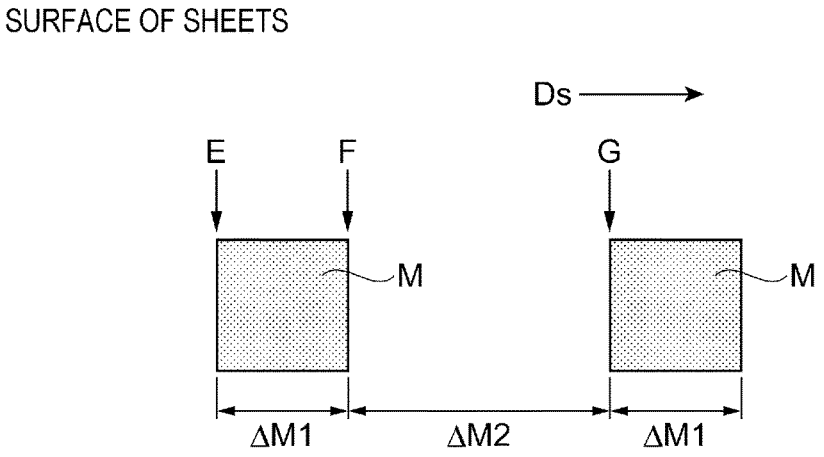
FIGS. 4A and 4B are schematic views illustrating a method in which the printer control section counts marks.
Figure 4B:
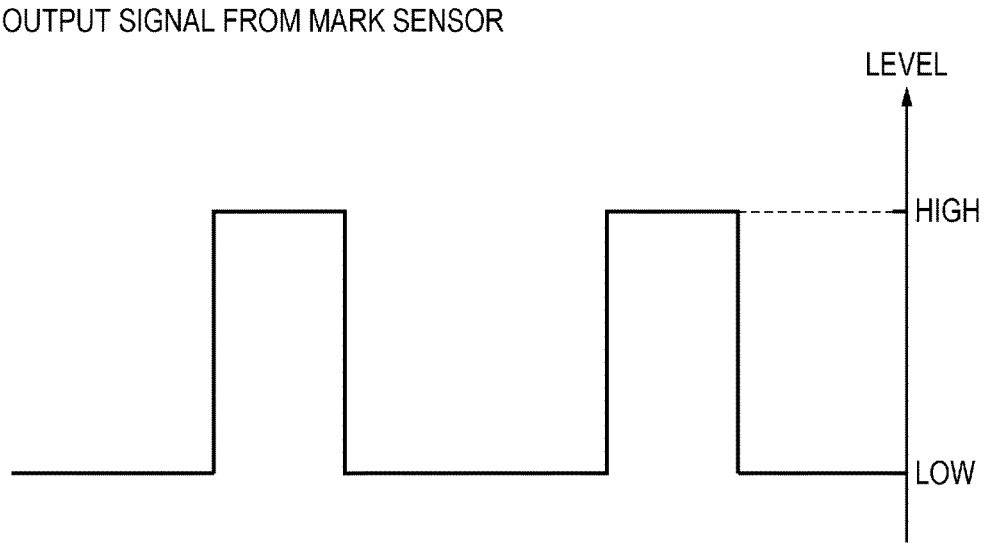

FIGS. 4A and 4B are schematic views illustrating a method in which the printer control section counts marks. More specifically, FIG. 4A illustrates a state of the front surface of the sheet S, and FIG. 4B illustrates a state of an output signal from the mark sensor 80. In FIGS. 4A and 4B, it is assumed that the sheet S (marks M) stays fixed and the mark sensor 80 moves in the transport direction Ds. In addition, the mark sensor 80 moves to locations E, F, and G indicated by the arrows in this order. However, it should be noted that in an actual transport operation, the mark sensor 80 stays fixed and the sheet S (marks M) is transported in a direction that is the reverse of the transport direction Ds. With reference to FIGS. 4A and 4B, a description will be given below of a method in which the printer control section 100 counts the marks M.

When the output signal from the mark sensor 80 changes from the low level to the high level at the location E, the printer control section 100 starts to measure a first transport amount Lh of the sheet S. In this case, the printer control section 100 may measure the first transport amount Lh by determining a change in the angle of the rotatable drum 30 from an output of the drum encoder E30, because the rotatable drum 30 rotates in relation to the transport of the sheet S.

When the first transport amount Lh exceeds a first transport threshold L1 and the output signal of the mark sensor 80 changes from the high level to the low level, the printer control section 100 starts to measure a second transport amount Lm of the sheet S. More specifically, when the output signal from the mark sensor 80 changes from the high level to the low level at the location F, the printer control section 100 starts to measure the second transport amount Lm of the sheet S. In this case, the printer control section 100 measures the second transport amount Lm by determining a change in the angle of the rotatable drum 30 from an output of the drum encoder E30, because the rotatable drum 30 rotates in relation to the transport of the sheet S.

When the second transport amount Lm exceeds the second transport threshold L2 while the mark sensor 80 continues to output the low-level signal and then the output signal from the mark sensor 80 changes from the low level to the high level, the printer control section 100 counts high-level pulses corresponding to marks M. More specifically, when the output signal from the mark sensor 80 changes from the low level into the high level at the location G, the printer control section 100 counts high-level pulses corresponding to marks M.

If the transport direction of the sheet S has a negative value, namely, if the sheet S is transported in a direction that is the reverse of the transport direction Ds, the printer control section 100 may increment the count value of the counter 200. If the transport direction of the sheet S has a positive value, namely, if the sheet S is transported in the transport direction Ds, or in the forward direction, the printer control section 100 may decrement the count value of the counter 200.

The printer control section 100 counts high-level pulses corresponding to marks M by repeating the above control operations at the locations E, F, and G, and updates the count value stored in the counter 200. In other words, the printer control section 100 counts marks M that have passed through the mark detecting section 8 by repeating the control operations at the locations E, F, and G.

The first transport threshold L1 is preferably set to less than a width ΔM1 of each mark M in the transport direction Ds. For example the first transport threshold L1 may be set to less than 90% of the width ΔM1 of each mark M and stored in the built-in memory in the printer control section 100. It is assumed that the first transport threshold L1 is set in this manner and the first transport amount Lh of the sheet S greatly differs from the width ΔM1 of the marks M during a period in which a high-level signal is continuously output. This continuous output of the high-level pulse could be attributed to an object other than a mark M, such as a foreign object adhering to the sheet S, or a vibration of the sheet S.

The second transport threshold L2 is preferably set to less than a distance ΔM2 between two adjacent marks M in the transport direction Ds. For example the second transport threshold L2 may be set to less than 90% of the distance ΔM2 between two adjacent marks M and stored in the built-in memory in the printer control section 100. It is assumed that the second transport threshold L2 is set in this manner and the second transport amount Lm of the sheet S greatly differs from the distance ΔM2 between the two adjacent marks M during a period in which a low-level signal is continuously output. This continuous output of the low-level pulse could be attributed to an object other than a mark M, such as a foreign object adhering to the sheet S, or a vibration of the sheet S.

The above configuration reduces the risk of erroneously detecting high-level pules corresponding to marks M. Consequently, the counter 200 can count accurately the high-level pules corresponding to the marks M and store a count value with high precision. Therefore, the printer control section 100 can get to know the number of marks M that have passed through the mark detecting section 8 by referring to the count value of the counter 200, thereby obtaining precise information regarding the transport amount of the sheet S.

The foregoing first embodiment produces the effects described below. First, a printer 1 is provided with a steering mechanism 7 installed upstream of a mark detecting section 8 in a transport path. When a sheet S is transported in the transport direction Ds, the steering mechanism 7 corrects the shift of an edge of the sheet S on the basis of information regarding the location of the edge of the sheet S in the width direction Dw which is detected by an edge sensor 70. In this way, the steering mechanism 7 controls the shift amount of the sheet S at a printing location in the processing section 3 so that the shift amount decreases. Consequently, the printer 1 can form images (images A1 and marks M) on the sheet S at fixed locations with respect to the edge of the sheet S in a first printing operation and a second printing operation.

Second, a printer 1 is provided with a mark detecting section 8 installed downstream of a steering mechanism 7 in a transport path. The mark detecting section 8 adjusts the location of the mark sensor 80 so as to follow a varying location of an edge of the sheet S, or a laterally displaced edge of the sheet S, on the basis of information regarding the location of the edge of the sheet S in the width direction Dw which is detected by an edge sensor 70. Consequently, in a rewinding operation in which the steering mechanism 7 does not operate and the sheet S is laterally displaced, the mark sensor 80 is disposed and kept at a fixed location with respect to the edge of the sheet S and can detect mark M stably without failure.

Third, a printer 1 is provided with a steering mechanism 7 and a mark detecting section 8 that share a detection result from an edge sensor 70 which indicates the location of an edge of the sheet S. Sharing the detection result obviates the need to prepare a new edge sensor 70 for use in adjusting the location of the mark sensor 80, thereby limiting an increase in the cost of the printer 1.

Fourth, a printer 1 is provided with a printer control section 100. The printer control section 100 refers to information regarding the transport amount of the sheet S which has been obtained in a rewinding operation and controls an initial print position for a second printing operation so that no extra blank is formed. Consequently, the printer 1 can reduce the risk of forming an extra blank, namely, causing a printing loss between the first printing operation and the second printing operation, or between an image formed before the stop of the printing operation and an image to be formed after the resuming of the printing operation. Thus, the printer 1 achieves high printing productivity.

Second Embodiment

Figure 5:
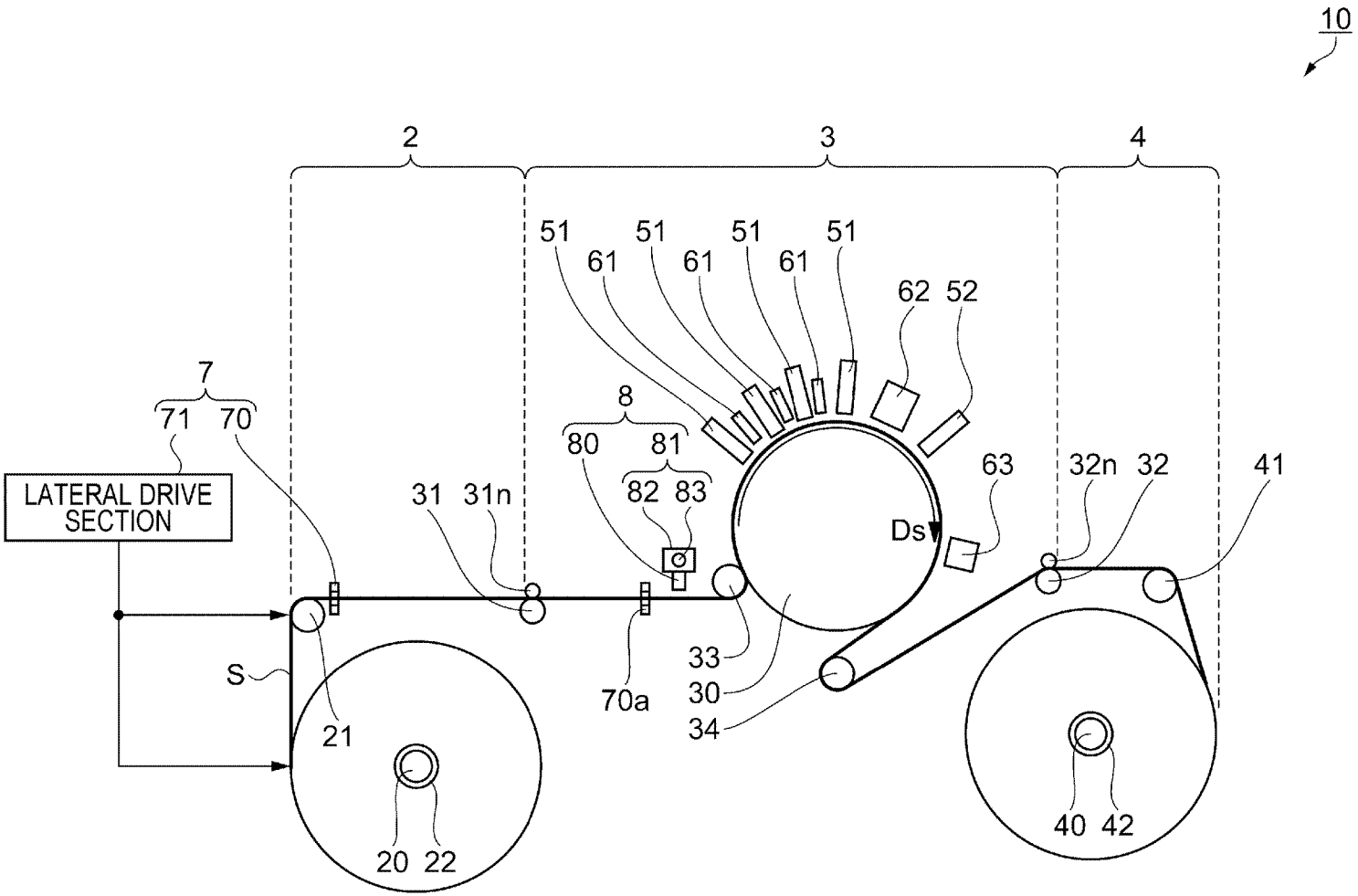
FIG. 5 is a schematic view illustrating a configuration of a printer according to a second embodiment of the invention.

FIG. 5 is a schematic view illustrating a configuration of a printer according to a second embodiment of the invention. A printer 10 according to the second embodiment differs from the printer 1 according to the first embodiment in including two edge sensors; edge sensors 70 and 70*a*. With reference to FIG. 5, the printer 10 according to the second embodiment will be described below mainly regarding differences from the printer 1. Constituent elements that are the same as in the first embodiment are denoted by the same reference characters and will not be described.

As illustrated in FIG. 5, the edge sensor 70 in the printer 10 is disposed between a driven roller 21 and a front drive roller 31, whereas the edge sensor 70*a* therein is disposed between the front drive roller 31 and a mark detecting section 8. The edge sensors 70 and 70*a* have the same configuration and each obtain information regarding the location of an edge of a sheet S in a width direction Dw by detecting the edge location of the sheet S.

The detection result from the edge sensor 70 which indicates the edge location of the sheet S is used by a steering mechanism 7 to adjust the locations of a feeding axis 20 and the driven roller 21. The detection result from the edge sensor 70*a* which indicates the edge location of the sheet S is used by the mark detecting section 8 to adjust the location of a mark sensor 80. More specifically, the steering mechanism 7 adjusts the locations of the feeding axis 20 and the driven roller 21 on the basis of the detection result from the edge sensor 70 so as to reduce the lateral displacement of the sheet S or a change in the edge location of the sheet S. The mark detecting section 8 adjusts the location of the mark sensor 80 on the basis of the detection result from the edge sensor 70*a* so as to follow a shifted edge of the sheet S or the laterally displaced sheet S.

The edge sensor 70 between the driven roller 21 and the front drive roller 31 is disposed close to the steering mechanism 7. In addition, the front drive roller 31 is disposed between the edge sensor 70 and the mark detecting section 8 (mark sensor 80). The edge sensor 70*a* between the front drive roller 31 and a driven roller 33 is disposed close to the mark detecting section 8. Thus, the front drive roller 31 is not disposed between the edge sensor 70*a* and the mark detecting section 8 (mark sensor 80)

If the sheet S runs over the front drive roller 31, for example, the location of an edge of the sheet S in the width direction Dw may be changed. Assuming that the sheet S runs over the front drive roller 31 with its edge location changed, it is necessary to adjust the location of the mark sensor 80 on the basis of information regarding the edge location of a part of the sheet S which has run over the front drive roller 31.

If the sheet S runs over the front drive roller 31 with its edge location changed, information regarding the edge of the sheet S which is detected by the edge sensor 70 is unsuitable for the adjustment of the location of the mark sensor 80. This is because this information indicates the edge location of a part of the sheet S that has not yet run over the front drive roller 31. In contrast, the information regarding the edge location of the sheet S which is detected by the edge sensor 70*a* is suitable for the adjustment of the location of the mark sensor 80. This is because this information indicates the edge location of a part of the sheet S that has already run over the front drive roller 31.

By adjusting the location of the mark sensor 80 on the basis of the information regarding the edge location of the sheet S which is detected by the edge sensor 70*a*, the location of the mark sensor 80 can be adjusted appropriately even when the sheet S runs over the front drive roller 31 with its edge location changed. Therefore, the mark sensor 80 can detect the marks M stably without failure. Consequently, the printer control section 100 can count marks M accurately, obtaining precise information regarding the transport amount of the sheet S.

For the above reason, the edge sensor 70*a* for use in obtaining information regarding the edge location of the sheet S is preferably disposed close to the mark sensor 80 without the front drive roller 31 therebetween. As described above, the mark sensor 80 is mounted on a carriage 82 and movable in the width direction Dw by a guide rail 83 and a support mechanism that supports the guide rail 83. Thus, the carriage 82, the guide rail 83, the support mechanism that supports the guide rail 83, and some other components are disposed close to the mark sensor 80. Therefore, the edge sensor 70*a* is more preferably disposed closer to the mark sensor 80 without interfering with the arrangement of the above components.

The entire disclosure of Japanese Patent Application No. 2015-055786, filed Mar. 19, 2015 is expressly incorporated by reference herein.

What is claimed is:

1. A printing apparatus comprising:

a mark sensor;

a moving section that can move the mark sensor in a direction intersecting a transport direction of a web;

a transport mechanism configured to transport the web in the transport direction and in a reverse direction;

a web edge sensor that can detect a location of an edge of the web, wherein the web edge sensor is positioned upstream of the mark sensor with respect to the transport direction; and a control section that controls the moving section to compensate for a location of the mark sensor such that the position of the mark sensor is fixed with respect to the edge of the web, on the basis of a detection result from the web edge sensor, the detection result indicating the location of the edge of the web.

2. The printing apparatus according to claim 1, further comprising a steering section that corrects a shift of the web in the direction intersecting the transport direction when the web is transported in a forward direction, wherein the control section corrects the shift of the web in the direction intersecting the transport direction, on the basis of the detection result from the web edge sensor which indicates the location of the edge of the web.

3. The printing apparatus according to claim 2, wherein when the web is transported in the reverse direction, the control section controls the moving section to compensate for the location of the mark sensor, on the basis of the detection result from the web edge sensor which indicates the location of the edge of the web.

4. The printing apparatus according to claim 2, wherein the steering section is positioned upstream of a printing section.

5. The printing apparatus according to claim 1, wherein the mark sensor has a detection spot that is larger than a width of a mark.

6. A mark detection method using a printing apparatus, the printing apparatus including a mark sensor, a web edge sensor capable of detecting a location of an edge of a web, and a moving section that can move the mark sensor in a direction intersecting a transport direction of the web, the web edge sensor positioned upstream of the mark sensor with respect to a transport direction, the mark detection method comprising:

detecting a mark while moving the moving section to compensate for a location of the mark sensor, on the basis of a detection result from the web edge sensor such that the mark sensor is at a fixed position with respect to the edge of the web, the detection result indicating the location of the edge of the web, and controlling the location of the edge of the web based on the same detection result.

* * * * *